US011122869B2

(12) United States Patent
Gunie

(10) Patent No.: US 11,122,869 B2
(45) Date of Patent: Sep. 21, 2021

(54) CLASP FOR CUSTOMISABLE FANCY BRACELET

(71) Applicant: Robin Gunie, Les Avanchers Valmorel (FR)

(72) Inventor: Robin Gunie, Les Avanchers Valmorel (FR)

( * ) Notice: Subject to any disclaimer, the term of this patent is extended or adjusted under 35 U.S.C. 154(b) by 274 days.

(21) Appl. No.: 16/340,534

(22) PCT Filed: Oct. 19, 2017

(86) PCT No.: PCT/FR2017/052878
§ 371 (c)(1),
(2) Date: Apr. 9, 2019

(87) PCT Pub. No.: WO2018/087447
PCT Pub. Date: May 17, 2018

(65) Prior Publication Data

US 2020/0046090 A1 Feb. 13, 2020

(30) Foreign Application Priority Data

Nov. 8, 2016 (FR) ..... 1660786

(51) Int. Cl.
*A44C 5/20* (2006.01)

(52) U.S. Cl.
CPC ..... *A44C 5/2076* (2013.01); *A44C 5/2085* (2013.01); *A44D 2200/12* (2013.01); *A44D 2203/00* (2013.01)

(58) Field of Classification Search
CPC ..... A44C 5/2076; A44C 5/20; A44C 5/2023; A44C 5/2057; A44C 5/18; A44C 5/185; A44B 11/006; A44D 2203/00
See application file for complete search history.

(56) References Cited

U.S. PATENT DOCUMENTS 2,051,591 A * 8/1936 Brogan ..... A44C 5/2071 24/116 A
2,644,992 A * 7/1953 McFarland ..... A44C 5/185 24/116 A
5,689,867 A * 11/1997 Katz ..... A44C 5/185 24/265 B
6,729,159 B2 * 5/2004 Rose ..... A44C 17/0208 24/574.1
9,498,028 B2 * 11/2016 Caspi ..... A44C 5/185
2011/0138583 A1 6/2011 Fiedler
(Continued)

FOREIGN PATENT DOCUMENTS

EP 2277399 A1 1/2011
JP H10 179219 A 7/1998

*Primary Examiner* — Jack W Lavinder
(74) *Attorney, Agent, or Firm* — Ware, Fressola, Maguire & Barber LLP

(57) ABSTRACT

A clasp for a fancy bracelet comprises a body (1) having two opposite sides to which respective ones of the ends of the bracelet come to be fastened. The body of the clasp is configured as two complementary portions (1A, 1B), each of which forms one respective side of the clasp, and holding together by a magnetic effect. Each portion of the clasp has a groove in its fastening side for fastening to a respective end of the bracelet, which groove is a groove (3A, 3B) partially closed with undercutting, and extends longitudinally between two groove ends along the fastening side.

11 Claims, 6 Drawing Sheets

(56) References Cited

U.S. PATENT DOCUMENTS

| | | | | |
|---|---|---|---|---|
| 2011/0179604 | A1 | 7/2011 | Desser | |
| 2012/0000038 | A1* | 1/2012 | Humphries | A44C 5/2085 24/303 |
| 2013/0305780 | A1* | 11/2013 | Christ | A44C 5/0007 63/3.1 |
| 2014/0130544 | A1 | 5/2014 | Sanchez-Valenzuela | |
| 2016/0270491 | A1* | 9/2016 | Spencer | A44C 5/2085 |

* cited by examiner

CLASP FOR CUSTOMISABLE FANCY BRACELET

CROSS REFERENCE TO RELATED APPLICATIONS

This application is the U.S. National Stage of International Application Number PCT/FR2017/052878 filed on Oct. 19, 2017, which application claims priority under 35 USC § 119 to French Patent Application No. 1660786 filed on Nov. 8, 2016. Both applications are hereby incorporated by reference in their entirety.

TECHNICAL FIELD

The present invention relates to the field of fancy or "costume" bracelets, e.g. single-row or multi-row bracelets made of beads or of woven fabric, and in particular to clasps for such fancy bracelets.

PRIOR ART

Patent Documents EP 2 277 399, U.S. Pat. No. 5,689,867, US2014/130544, US2011/179604 and JPH10179219 each disclose a fancy bracelet clasp that makes it possible to close the bracelet by attaching together the two ends of the bracelet on two opposite sides of the clasp.

The clasp of U.S. Pat. No. 5,689,867 is designed to be partially interchangeable. However, in that known clasp, the fastening of the ends of the bracelet to the opposite sides of the clasp is rendered permanent by soldering. It should be noted that such fastening by soldering is not suitable for bracelets made of fabric.

SUMMARY OF THE INVENTION

An object of the invention is to propose another type of clasp for a fancy bracelet that is less costly to manufacture and that makes it possible to interchange/customize the bracelet simply and quickly.

To this end, the invention provides a clasp for a fancy bracelet, the clasp comprising a body having two opposite sides to which respective ones of the ends of the bracelet come to be fastened, said body of the clasp being configured as two complementary portions, each of which forms one respective side of the clasp, and the two complementary portions being suitable for being held together by a magnetic effect, each portion of the clasp having a groove in its fastening side for fastening to a respective end of the bracelet, which groove extends longitudinally between two groove ends along the fastening side, said groove being partially closed with undercutting, said clasp being characterized in that said groove is closed at one of its ends and open at its other end, and in that said clasp portion is L-shaped and, at the same end as the closed end of the groove, is further provided with a side projection that projects transversely relative to the fastening sides and that is designed to close the open end of the groove in the complementary other portion of the body of the clasp when the two complementary portions of the clasp are held together by a magnetic effect.

The clasp of the invention may have the following features:

- each portion of the clasp body has a holding face that is opposite from the fastening side and that is provided with a keying hole and with a keying lug that co-operate respectively with a keying lug and with a keying hole with which the holding face of the other portion of the clasp body is provided;
- for each portion of the body, it is provided with at least one fastener configured firstly to be attached to one end of the bracelet and secondly to be suitable for being inserted into the groove while also being blocked against the edges of the undercutting of the groove;
- the fastener is a double-headed rivet passing through one of the ends of the bracelet;
- the fastener is a slide that is of T-shaped section and that is crimped to one of the ends of the bracelet; and
- the fastener is a slide in the form of a strip to which the end of the bracelet is suitable for being attached by attachment means, such as a hook, a loop, a ring, or a chain link.

The invention also provides a fancy bracelet including a clasp of the invention.

BRIEF DESCRIPTION OF THE DRAWINGS

The present invention can be better understood and other advantages appear on reading the following description and on examining the accompanying drawings, in which.

DESCRIPTION OF THE EMBODIMENTS

Figure 1:
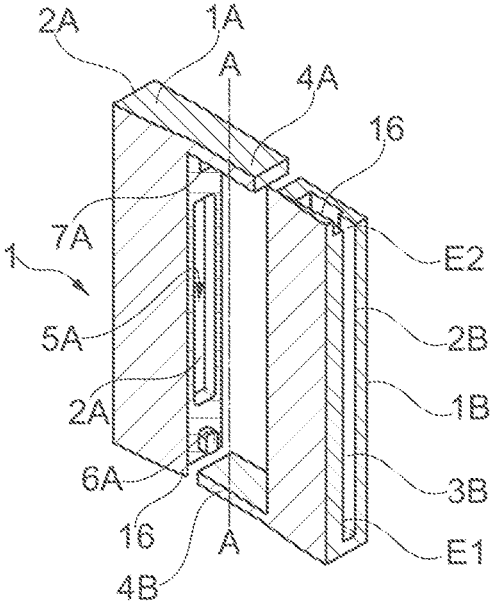
FIG. 1 is a perspective view of the two complementary portions of the clasp of the invention.
Figure 2:
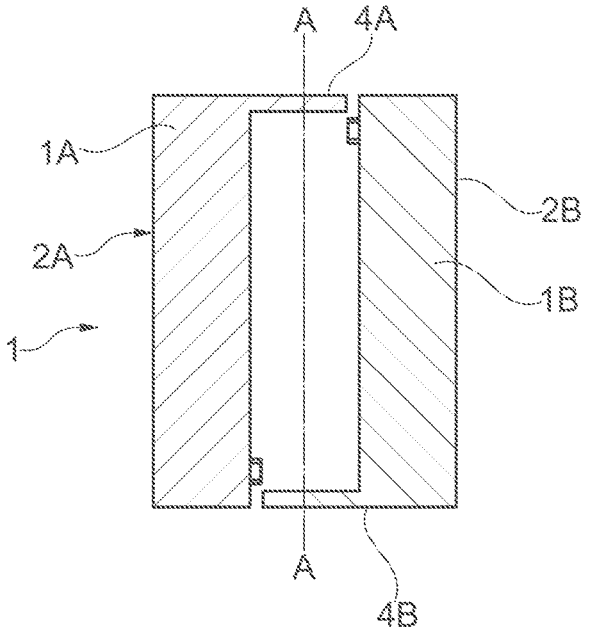
FIG. 2 shows the clasp of FIG. 1 as seen in a plan view.
Figure 3:
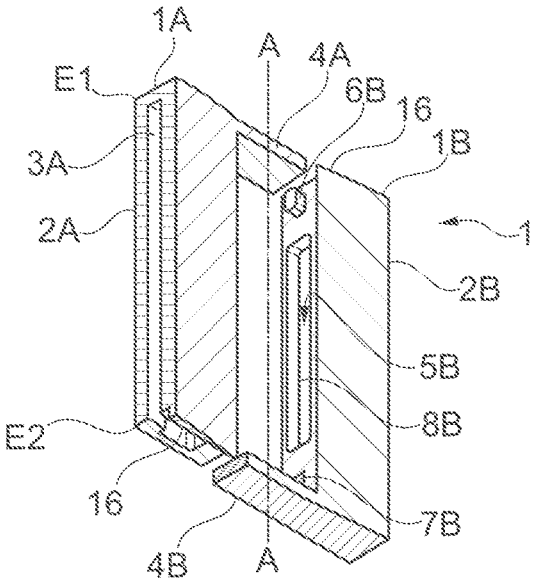
FIG. 3 shows the clasp of FIG. 1 as seen from another perspective.

FIGS. 1 to 3 show a clasp 1 of the invention for a fancy bracelet.

In particular, the clasp 1 is configured for single-row or multi-row bracelets of the following types: chain, macramé, beads, thongs, braided leather, ribbon, etc.

In FIGS. 1 to 3, the bracelet is not shown. This clasp 1 is symmetrical about a middle axis A-A. Preferably, it may be made of metal.

The clasp 1 has a body made up of two complementary portions 1A, 1B.

It has two opposite longitudinal fastening sides 2A, 2B to which respective ends of the bracelet come to be fastened.

In this example, each portion 1A, 1B of the clasp 1 is L-shaped in general shape. Each of the two portions 1A, 1B forms one respective side of the clasp, and, in this example, the two portions are designed to be held together by a magnetic effect.

On its fastening side for fastening to a respective end of the bracelet, each portion 1A, 1B of the clasp has a groove 3A, 3B partially closed with undercutting as shown in FIGS. 1 and 3.

In the figures, the groove is shown to be of T-shaped section.

The section of the groove could also be dovetail-shaped, etc.

This groove that is partially closed with undercutting has a longitudinal slot of width that is narrower than the base of the groove so as to form undercut edges on either side of the longitudinal slot that serve as blocking surfaces as explained below.

Each groove 3A, 3B extends longitudinally between two groove ends along the corresponding fastening side.

Each groove 3A or 3B is closed at one of its two ends E1 and open at its other end E2.

Figure 4:
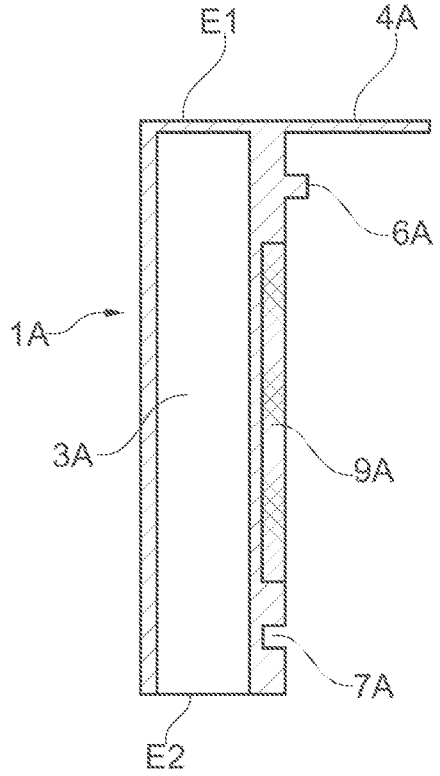
FIG. 4 is a section view of a portion of the clasp shown in FIG. 1.
Figure 5:
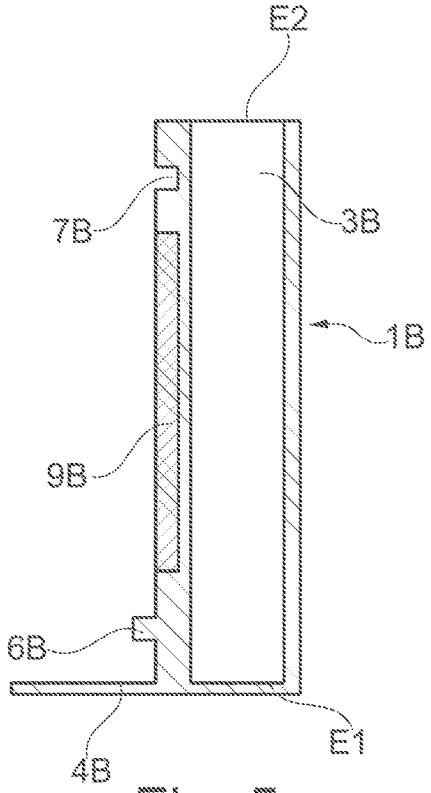
FIG. 5 is a section view of the portion of the clasp that is complementary to the portion shown in FIG. 4.

As shown in FIGS. 4 and 5, each of the L-shaped clasp portions 1A, 1B has a respective side projection 4A, 4B at the closed end E1 of the groove 3A, 3B, which side projection projects transversely relative to the fastening sides and thus relative to the middle axis A-A, and is configured to close the open end E2 of the groove 3B, 3A in the complementary other portion 1B, 1A of the body of the clasp when the two complementary portions 1A, 1B of the clasp are held together by a magnetic effect.

Figure 6:
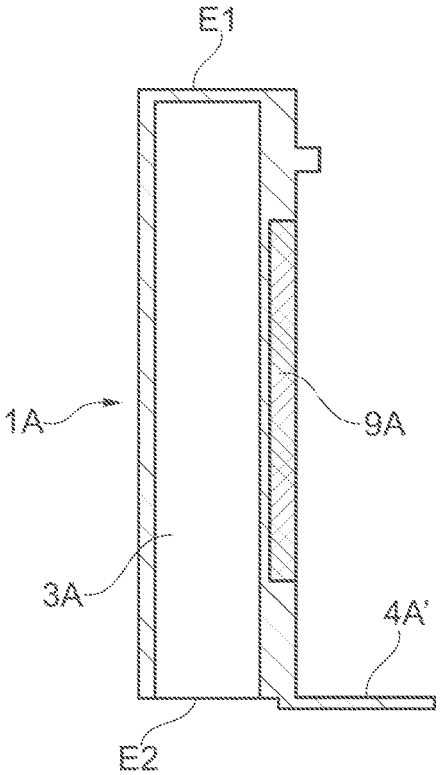
FIG. 6 is a section view of a portion of the clasp in another embodiment.
Figure 7:
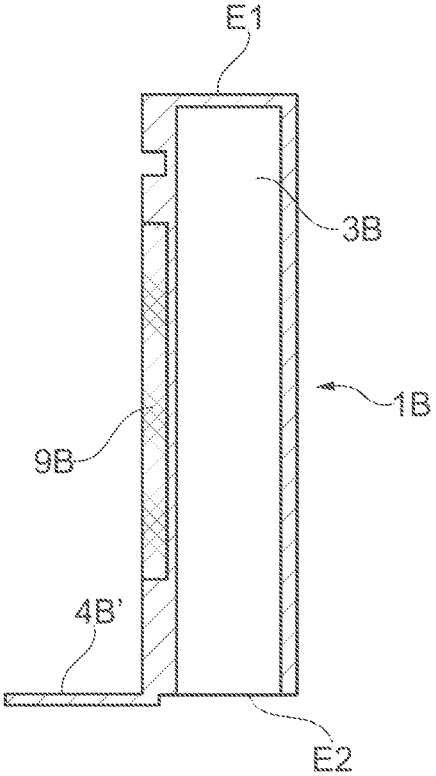
FIG. 7 is a section view of the portion of the clasp that is complementary to the portion shown in FIG. 6.

In another embodiment of the clasp, and as shown in FIGS. 6 and 7, each of the L-shaped portions 1A, 1B has a respective side projection 4A', 4B' at the open end E2 of the groove 3A, 3B, which side projection projects transversely relative to the fastening sides and thus relative to the middle axis A-A, and is designed to close the open end E2 of the groove 3B, 3A in the complementary other portion 1B, 1A of the body of the clasp when the two complementary portions 1A, 1B of the clasp are held together by a magnetic effect.

As can be seen in FIGS. 1 and 3, each portion 1A, 1B of the clasp body has a respective holding face 5A, 5B that is opposite from the corresponding fastening side and that is provided with a keying hole 6A, 6B and with a keying lug 7A, 7B. The keying hole 7A and the keying lug 6A of the portion 1A co-operate respectively with the keying lug 6B and with the keying hole 7B with which the holding face of the other portion 1B of the clasp body is provided.

As shown in FIGS. 1 and 3, at its end opposite from its side projection 4A, 4B, each of the portions 1A and 1B is provided with a respective flange 16, which is an extension of the body at its opening E2, and which is designed to mask the edge of the side projection of the opposite portion when the clasp is held. This flange 16 also makes it possible to guide the projection while the two portions 1A and 1B are being assembled together, and to increase the robustness of the clasp when it is assembled, in addition to the magnetic effect and to the keying lugs.

As can be seen in FIGS. 1 and 3, in its central portion, the holding face 5A or 5B is provided with a recess 8A, 8B, which is oblong in this example, and which serves to receive a magnet 9A, 9B that is shown, in particular, in FIGS. 4 to 7.

The lugs 6A, 6B and the holes 7A, 7B are disposed on either side of the respective recesses 8A, 8B in the axial direction A-A.

Figure 8:
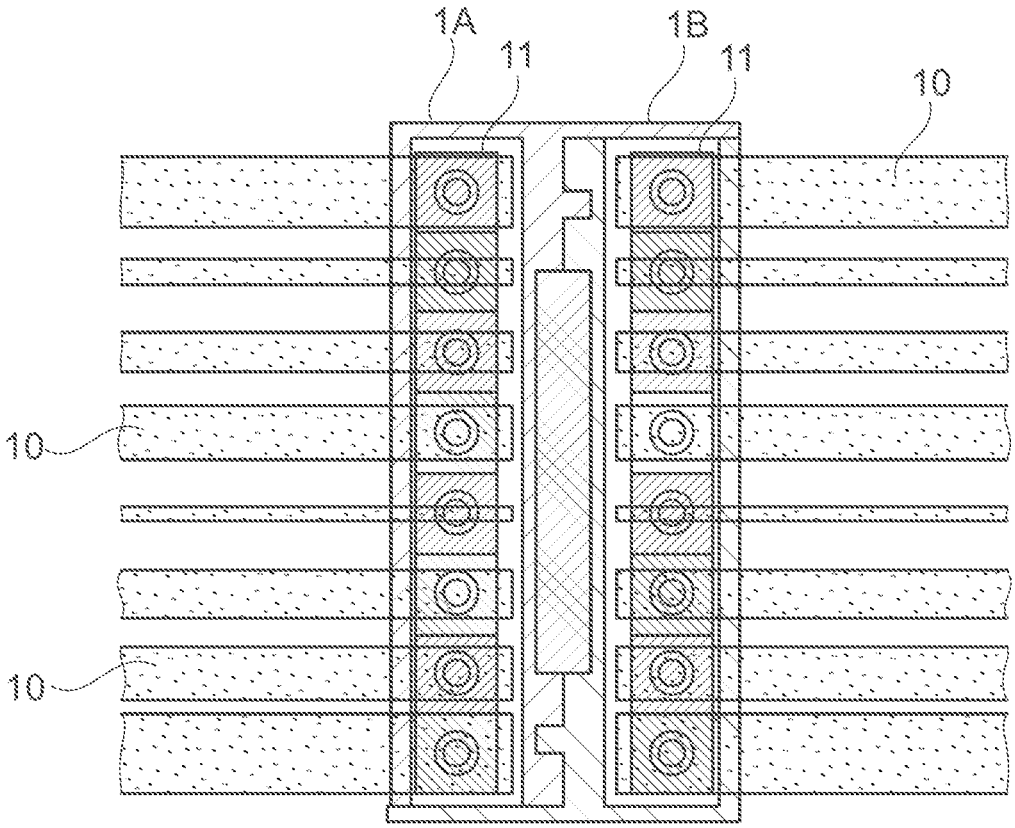
FIG. 8 is a section view of the two complementary portions of FIGS. 4 and 5 in the holding position for closing a fancy bracelet.

FIG. 8 shows the two portions 1A, 1B as held together by a magnetic effect in order to close a fancy bracelet 10, the bracelet in this example being made up of a plurality of rows.

Figure 9:
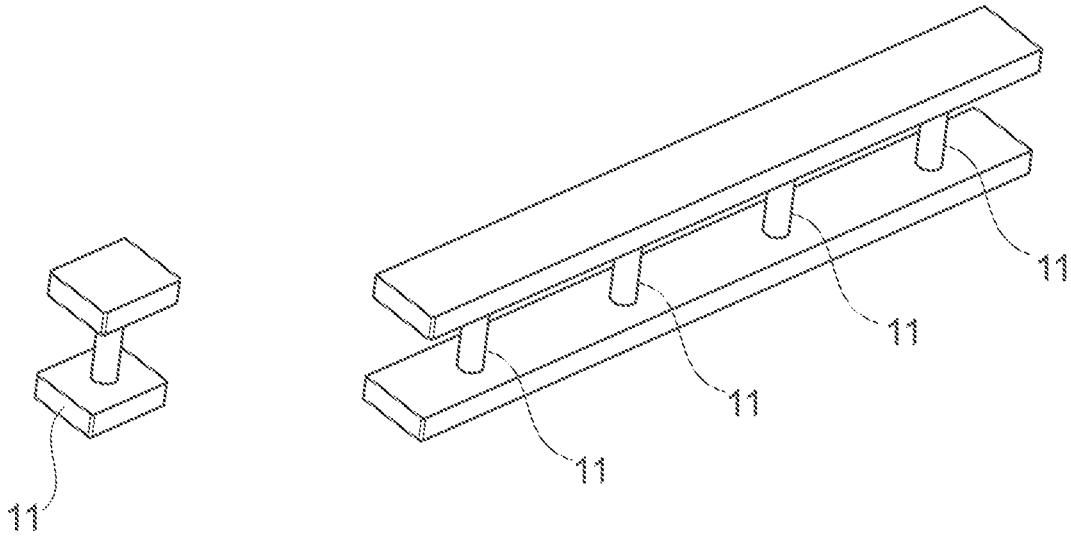
FIG. 9 is a perspective view of the fasteners of the invention that are of the double-headed rivet type.
Figure 10:
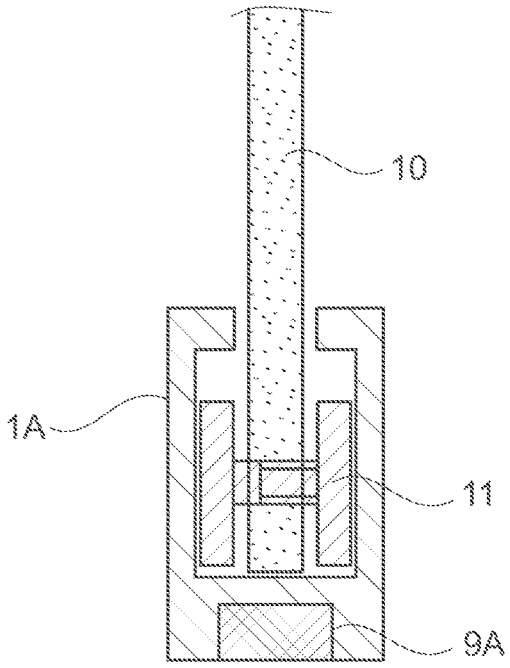
FIG. 10 is a section view of a portion of the clasp that is shown in FIG. 1 with a fastener in the form of a doubled-head rivet.
Figure 11:
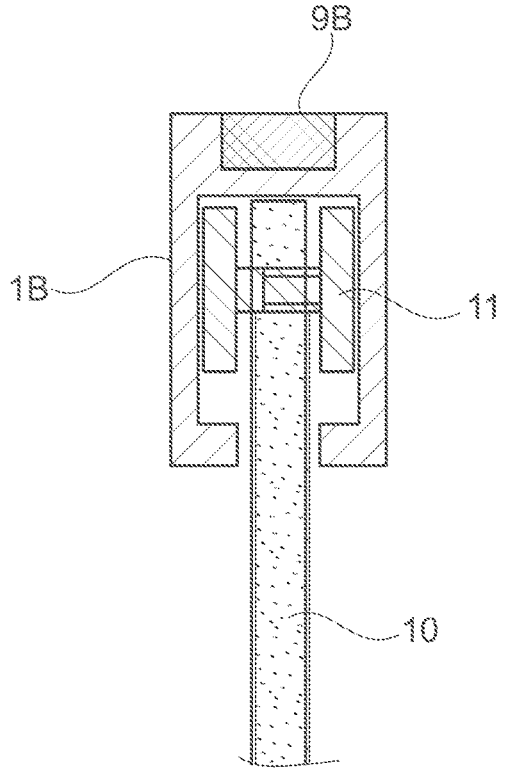
FIG. 11 is a section view of the portion of the clasp that is complementary to the portion shown in FIG. 10.
Figure 12:
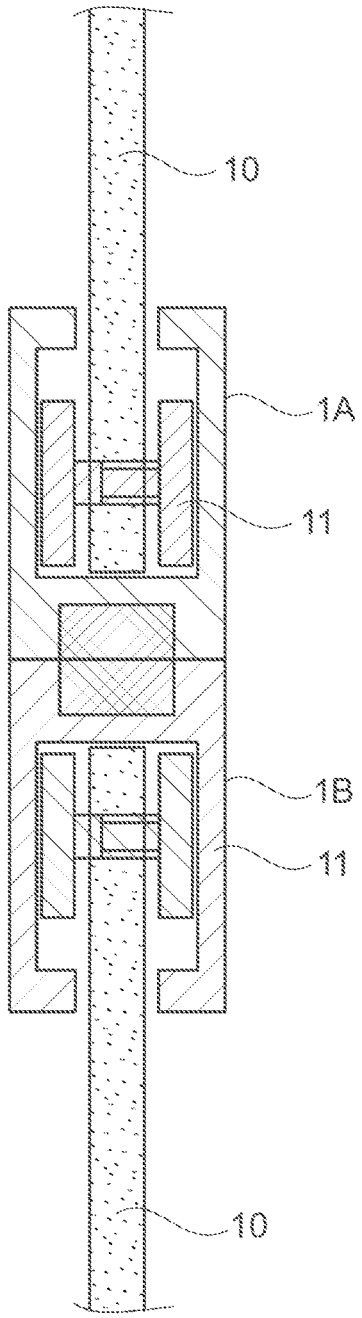
FIG. 12 is a section view of the two complementary portions of FIGS. 10 and 11 in the holding position for closing a fancy bracelet.

In FIG. 8, each row of the bracelet is attached inside the groove to a fastener 11 formed, for example, by a double-headed rivet, as shown in perspective in FIG. 9 and in section in FIGS. 10 to 12. In this example, the heads of the rivet are square in shape but they could also be circular in shape.

In this example, the double-headed rivets 11 pass through the various rows of the bracelet.

Figure 13:
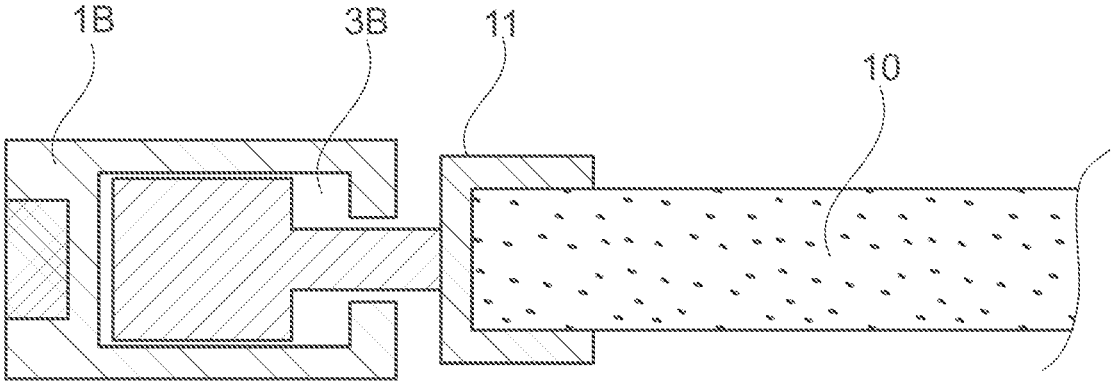
FIG. 13 is a section view of a portion of the clasp shown in FIG. 1 with a fastener of T-shaped section as crimped to the end of the bracelet.

However, it can be understood that the thickness of the row of the bracelet may be too large for its end to be inserted into the groove so as to be fastened with the fastener means 11 of the rivet type. Thus, a T-shaped fastener 11, as shown in FIG. 13, may be crimped to the end of the bracelet, and, in this example to the end of one row of the bracelet, outside the groove. This T-shaped type of fastener 11 may thus be of different sizes for receiving various shapes and thicknesses of bracelet row.

Figure 14:
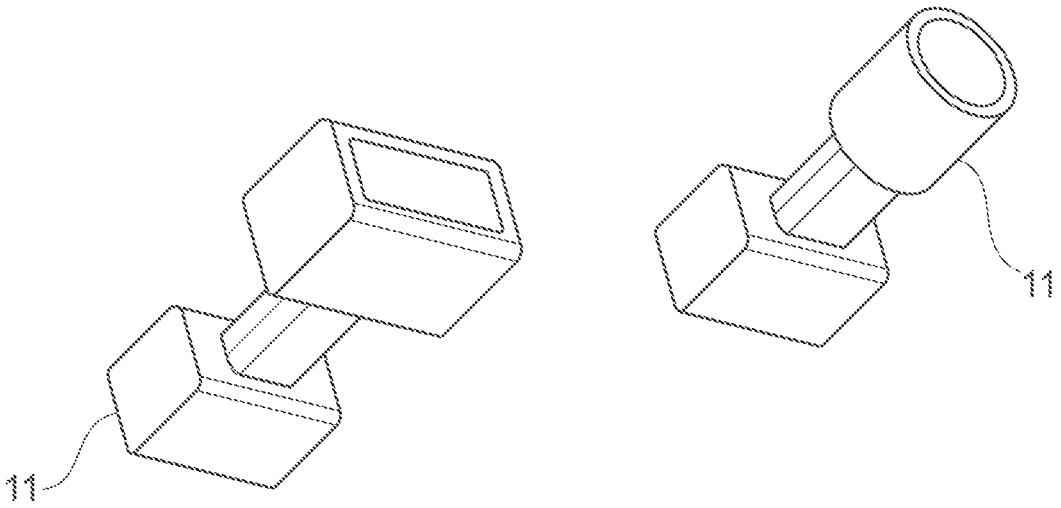
FIG. 14 is a perspective view of two distinct fasteners having T-shaped sections.

For example, the T-shaped fasteners 11 may be in the shapes of cylinders or cubes, depending on the type of row used, as can be seen in FIG. 14.

A plurality of T-shaped fasteners 11 or a plurality of rivets may form an integral unit in order to form a set of fasteners 11, as can be seen in FIGS. 8 and 9.

Figure 15:
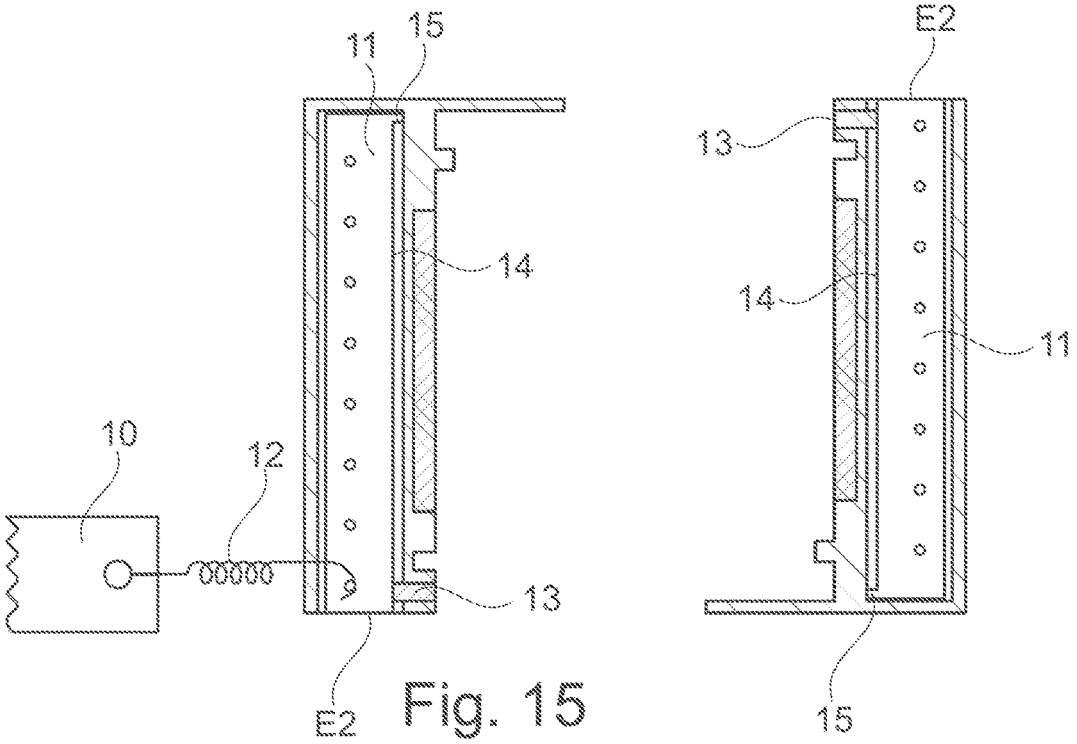
FIG. 15 is a section view of the two complementary portions of the clasp of the invention with a fastener in the form of a strip.

FIG. 15 shows a fastener 11 for the two portions 1A, 1B of the clasp, which fastener is a slide in the form of a strip to which the end of the row of the bracelet 10 can be attached by attachment means 12, which, in this example, are constituted by a hook. Other attachment means of the ring-type, loop-type, or chain-link-type may also be used.

Generally, it can be understood that the various kits of fasteners 11 are chosen as a function of the type of bracelet used.

It should be noted that the magnet 9A, 9B may have an additional function of holding the fastener 11 stationary by a magnetic effect in the groove when the fastener is made of metal.

In order to strengthen the holding-stationary effect, it is possible to provide a window in the recess 8A, 8B that opens into the groove so that a portion of the magnet faces the fasteners 11 directly.

Figure 16:
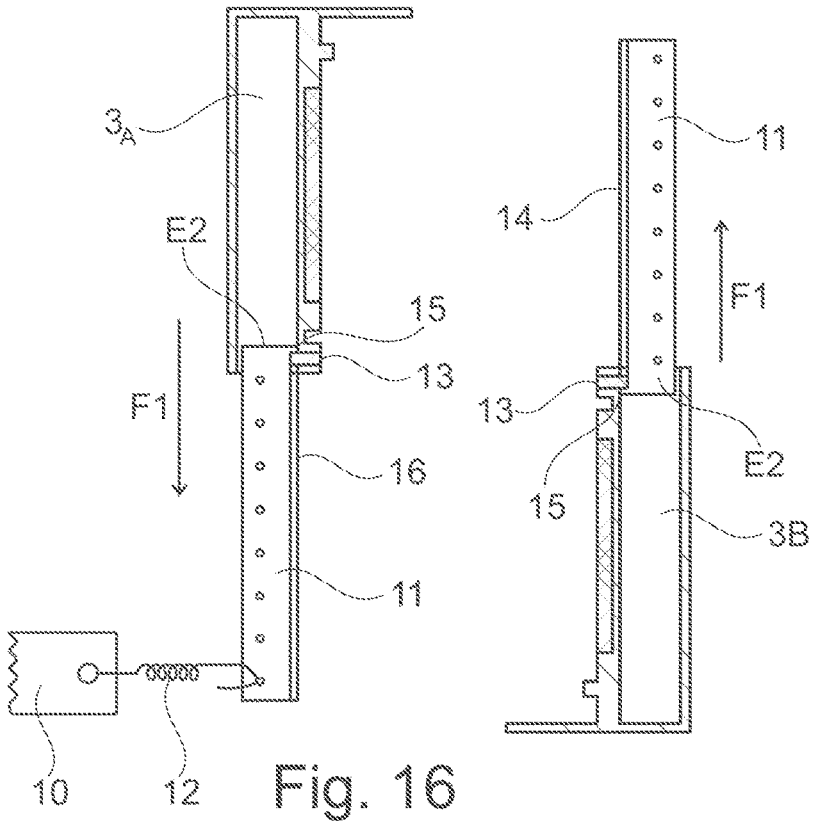
FIG. 16 is a section view of a portion of the clasp of the invention with a fastener in the form of a strip and as deployed.

It is also possible to make provision to hold the fastener 11 stationary and more particularly to hold the slide stationary when it is deployed out of the groove 3A, 3B in the direction indicated by the direction arrow F1, as shown in FIG. 16. In such a situation, a locking screw 13 is disposed at the end E2 of the groove 3A, 3B transversely to the slide, which is provided with a groove 14 configured to receive the locking screw 13. The groove 14 is closed at one of its ends by an abutment 15 against which the locking screw 13 comes to bear when the slide is deployed.

All the fasteners 11 shown in FIGS. 8 to 16 are designed to be suitable for being inserted via the open end E2 of the undercut groove, and for sliding along said groove while also being blocked by the edges of the undercut (i.e. while also being prevented from exiting through the longitudinal slot of the groove). The axial position of the fastener in the groove is unimportant for the invention. When the two portions 1A, 1B of the body of the clasp are held together by a magnetic effect, the projections 4A, 4B prevent the fasteners from coming out through the open ends E2 of the undercut grooves.

If the user wishes to change or customize the bracelet while keeping the same clasp 1, the user merely needs to separate the two portions 1A, 1B of the clasp 1 in order to release the open end E2 of each groove so as to extract the fasteners 11 through said open ends E2, and then the user merely needs to insert other fasteners 11, chosen from among the above-described kit of fasteners 11, attached to other bracelet rows 10 in the same grooves.

The invention claimed is:

1. A clasp for a fancy bracelet, the clasp comprising:

a body having two opposite fastening sides to which respective ones of ends of the bracelet come to be fastened, said body of the clasp being configured as two complementary portions comprising a first complementary portion and a second complementary portion, each of which forms one of the respective fastening sides of the clasp, and the two complementary portions being suitable for being held together by a magnetic effect, said first complementary portion and said second complementary portion of the clasp each have a groove in the fastening side for fastening to a respective end of the bracelet, said groove extends longitudinally between two groove ends along the fastening side, said groove being partially closed with undercutting, wherein each groove comprises two groove ends and is closed at one groove end and open at the other groove end, and in that at the same end as the closed groove end of the groove, each complementary portion is L-shaped with a short leg defined as a side projection that projects transversely relative to the fastening sides so that the side projection of the first complementary portion and the side projection of the second complementary portion are respectively configured to close the open groove end of the groove of the second complementary portion and to close the open groove end of the groove of the first complementary portion of the body of the clasp when the two complementary portions of the clasp are held together by a magnetic effect.

2. The clasp according to claim 1, wherein each complementary portion of the clasp body has a holding face that is opposite from the fastening side and that is provided with a keying hole and with a keying lug, the keying hole and the keying lug of the holding face of the first complementary portion cooperating respectively with the keying lug and with the keying hole of the holding face of the second complementary portion of the clasp body.

3. The clasp according to claim 2, wherein for each complementary portion of the body, the clasp is provided with at least one fastener configured firstly to be attached to one end of the bracelet and secondly to be suitable for being inserted into the groove while also being blocked against edges of the undercutting of the groove.

4. The clasp according to claim 3, wherein the fastener is a double-headed rivet passing through one of the ends of the bracelet.

5. The clasp according to claim 3, wherein the fastener is a slide that is of T-shaped section and that is crimped to one of the ends of the bracelet.

6. The clasp according to claim 3, wherein the fastener is a slide in the form of a strip to which the end of the bracelet is suitable for being attached by attachment means, such as a hook, a loop, a ring, or a chain link.

7. A fancy bracelet comprising a clasp according to claim 1.

8. The clasp according to claim 1, wherein for each complementary portion of the body, the clasp is provided with at least one fastener configured firstly to be attached to one end of the bracelet and secondly to be suitable for being inserted into the groove while also being blocked against edges of the undercutting of the groove.

9. The clasp according to claim 8, wherein the fastener is a double-headed rivet passing through one of the ends of the bracelet.

10. The clasp according to claim 8, wherein the fastener is a slide that is of T-shaped section and that is crimped to one of the ends of the bracelet.

11. The clasp according to claim 8, wherein the fastener is a slide in the form of a strip to which the end of the bracelet is suitable for being attached by attachment means, such as a hook, a loop, a ring, or a chain link.

* * * * *